US008314763B2

(12) United States Patent
Park et al.

(10) Patent No.: US 8,314,763 B2
(45) Date of Patent: Nov. 20, 2012

(54) DISPLAY DEVICE TRANSFERRING DATA SIGNAL WITH CLOCK

(75) Inventors: Jae-Jin Park, Seongnam-si (KR); Dong-Uk Park, Yongin-si (KR); Jin-Ho Seo, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1169 days.

(21) Appl. No.: 12/167,393

(22) Filed: Jul. 3, 2008

(65) Prior Publication Data

US 2009/0015537 A1 Jan. 15, 2009

(30) Foreign Application Priority Data

Jul. 11, 2007 (KR) ..... 10-2007-0069729

(51) Int. Cl.
*G09G 3/36* (2006.01)

(52) U.S. Cl. ..... 345/98; 345/99; 345/100

(58) Field of Classification Search ..... 345/98–100
See application file for complete search history.

(56) References Cited

U.S. PATENT DOCUMENTS

| | | | | |
|---|---|---|---|---|
| 4,425,666 | A * | 1/1984 | Groth, Jr. | 375/275 |
| 2004/0193821 | A1 * | 9/2004 | Ruhovets et al. | 711/167 |

FOREIGN PATENT DOCUMENTS

| | | | |
|---|---|---|---|
| JP | 2001-585272 | | 10/2001 |
| JP | 2002-344544 | | 11/2002 |
| KR | 100562860 | B1 | 3/2006 |
| KR | 1020060026565 | * | 5/2006 |
| KR | 1020060041920 | A * | 5/2006 |

* cited by examiner

*Primary Examiner* — Waseem Moorad
(74) *Attorney, Agent, or Firm* — Volentine & Whitt, PLLC

(57) ABSTRACT

A display device includes; a panel, a timing controller generating an embedded clock data signal combining image data and a clock signal, and a column driver driving the panel in response to the embedded clock data signal. The data bits within the embedded clock data signal are communicated at one of three voltage levels in a three-level signaling scheme, and the timing controller determines one of the three voltage levels for a current data bit (DIN[n]) within the embedded clock data signal in relation to a voltage level of a previous data bit (DIN[n−1]) within the embedded clock data signal.

15 Claims, 5 Drawing Sheets

DISPLAY DEVICE TRANSFERRING DATA SIGNAL WITH CLOCK

CROSS-REFERENCE TO RELATED APPLICATIONS

This U.S. non-provisional patent application claims priority under 35 U.S.C. §119 to Korean Patent Application No. 10-2007-0069729 filed Jul. 11, 2007, the subject matter of which is hereby incorporated by reference.

SUMMARY OF THE INVENTION

The present invention relates generally to flat panel displays and more particularly to an intra-panel interface for the flat panel display.

Embodiments of the invention are directed to a display device having an intra-panel interface capable of reducing the number of channels between a timing controller and a column driver in a flat panel display device.

In one embodiment, the invention provides a display device including; a panel, a timing controller generating an embedded clock data signal combining image data and a clock signal, and a column driver driving the panel in response to the embedded clock data signal, wherein data bits within the embedded clock data signal are communicated at one of three voltage levels in a three-level signaling scheme, and the timing controller determines one of the three voltage levels for a current data bit (DIN[n]) within the embedded clock data signal in relation to a voltage level of a previous data bit (DIN[n−1]) within the embedded clock data signal.

In another embodiment, the invention provides a display device including a timing controller configured to generate an embedded clock data signal wherein data bits within the embedded clock data signal are communicated at one of three voltage levels in a three-level signaling scheme, wherein each one of the three voltage levels corresponds respectively to a high, low, and middle state, and the embedded clock data signal comprises a dummy bit communicated in a first time period and having the middle state, and a clock bit communicated in a time period next to the first time period and having either the high state or the low state; and a column driver receiving the embedded clock data signal and recovering the clock bit from the embedded clock data signal, wherein the clock bit has the high state if a previous data bit within the embedded clock data signal has the middle state and a next previous data bit has the high state, but the clock bit has the low state if the previous data bit has the middle state and a next previous data has the low state.

DETAILED DESCRIPTION OF EMBODIMENTS

Figure 1:
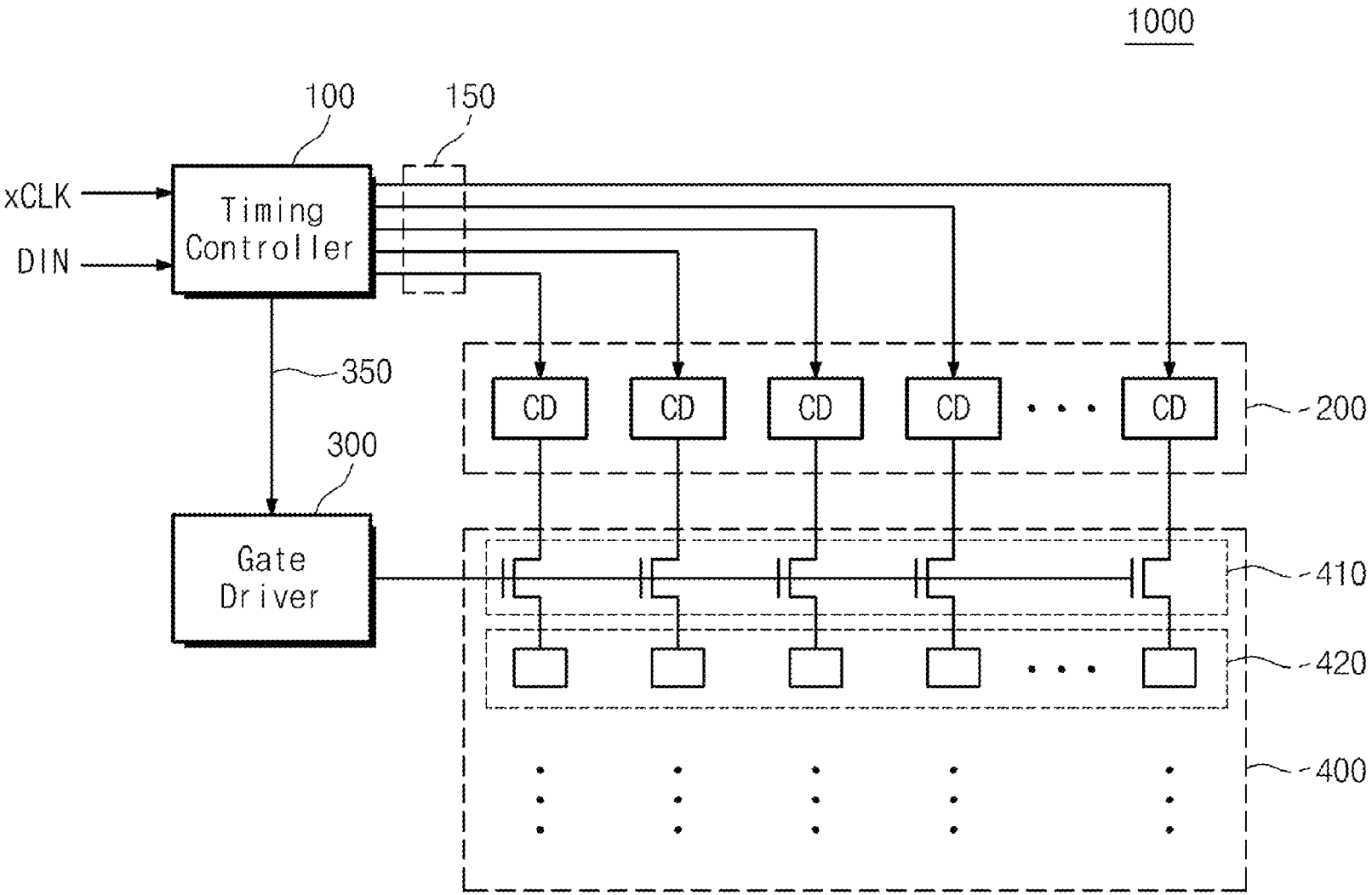
FIG. 1 is a block diagram of a flat panel display device according to an embodiment of the invention.

Embodiments of the invention will now be described in some additional detail with reference to the accompanying drawings. The present invention may, however, be embodied in different forms and should not be constructed as being limited to only the illustrated embodiments. Rather, the embodiments are presented as teaching examples. Throughout the written description and drawings, like reference numerals refer to like or similar elements.

Recent advances in the fabrication of flat panel displays (FPDs) have allowed these devices to become ever more commonly used in conjunction with consumer electronics such as computers and televisions. This is especially true of liquid crystal display (LCD) devices that provide visual images using the electrical and optical properties of certain liquid crystal materials. Advances in LCD devices have lead to much larger screen sizes and better overall performance (e.g., higher resolution).

LCD devices are generally configured with a flat liquid crystal panel on which an image is displayed, and a display module including a frame that mechanically assembles an optical module and a control board operatively coupled to the flat liquid crystal panel. Constituent circuits in the display module usually include a controller, a power supply unit, a gate voltage generator, a gray-scale voltage generator, column drivers (or column driver ICs), and scan drivers (or scan drive ICs). The display module provides a number of channels between the control board and the column drive ICs. However, this channel provision causes certain performance problems such as electromagnetic interference (EMI), transmission media noise, and limits on resolution due to limited display data transmission bandwidth.

For that reason, the display module often communicates image data signals using a differential signaling mode in order to overcome the effects of EMI and other noise. In this manner, image data signals may be communicated at relatively high-frequency but with relatively low power consumption. There are several differential signaling techniques commonly used to communicate image data signals, including (e.g.,) low-voltage differential signaling (LVDS), reduced swing differential signaling (RSDS), and transition-minimized differential signaling (TMDS).

TMDS is a high-speed serial data communication mode commonly used in conjunction with a digital visual interface (DVI) and a high-definition multimedia interface (HDMI).

An intra-panel interface according to one embodiment of the invention operates with a clock signal included in an image data signal that is generated by a corresponding timing controller. By incorporating a clock signal into an image data signal, the intra-panel interface according to an embodiment of the invention is better able to communicate a batch of image data to associate with column drivers via a number of different data lines (or channels).

FIG. (FIG.) 1 is a block diagram of a flat panel display (FPD) device according to an embodiment of the invention. Referring to FIG. 1, a FPD 1000 generally comprises a timing controller 100, pluralities of column drivers 200, a gate driver 300, and a display unit 400.

Timing controller 100 is configured to control column drivers 200 and gate driver 300. Column drivers 200 are respectively connected to the sources of N-channel metal-oxide-semiconductor (NMOS) transistors 410 and gate driver 300 is connected to the gates of NMOS transistors 410. Respective pluralities of pixel electrodes 420 are connected to the drains of NMOS transistors 410. Thus, in the illustrated embodiment, display unit 400 comprises NMOS transistors 410 and pixel electrodes 420.

Timing controller 100 receives an input image data signal (DIN) and an external clock (xCLK) from an external source (e.g., a graphics card). Timing controller 100 generates column and gate signals that correspond to the input image data signal (DIN). The resulting column signals are transferred to column drivers 200 via first data lines 150 and the resulting gate signal is transferred to gate driver 300 via a second data line 350. Column and gate drivers, 150 and 350, are configured to control the NMOS transistors 410 that in turn activate the pixel electrodes 420.

Figure 2:
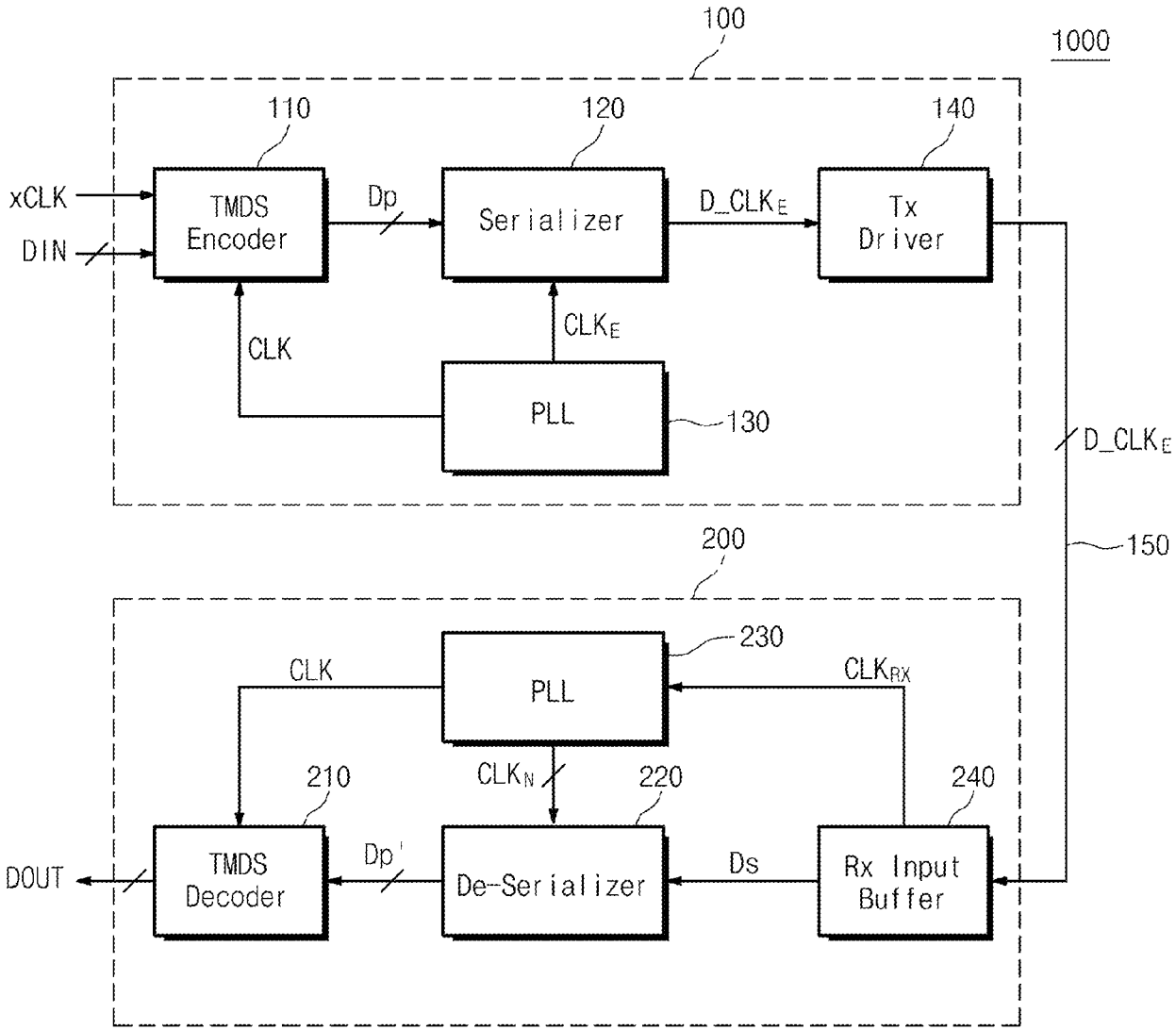
FIG. 2 is a block diagram further illustrating the timing controller and the column driver shown in FIG. 1.

FIG. 2 is a block diagram further illustrating timing controller 100 and column driver 200 of FIG. 1.

Referring to FIG. 2, timing controller 100 comprises a TMDS encoder 110, a data serializer 120, a first phase-locked loop (PLL) 130, and a transmission (Tx) driver 140. Column driver 200 comprises a TMDS decoder 210, a data deserializer 220, a second PLL 230, and a reception (Rx) input buffer 240.

TMDS encoder 110 receives the input image data signal (DIN) and the external clock (xCLK). TMDS encoder 110 encodes the input image data signal (DIN) such that it is compatible with a defined TMDS data communication mode and is also synchronous with the external clock xCLK. In certain embodiments of the invention, TMDS encoder 110 may also encode the input image data signal (DIN) to optimize a resulting output to a three-level signaling scheme. Such coding optimization to a three-level signaling scheme is adapted to generate middle-level signal components. However specifically accomplished, TMDS encoder 110 codes the input image data signal (DIN) in such a manner to reduce or minimize signal toggling. One example of a three-level signaling scheme will be described hereafter with reference to FIG. 3.

Data serializer 120 converts parallel image data signal (Dp) provided as an output by TMDS encoder 110 into a serial image data signal. Following this parallel to serial conversion, data serializer 120 incorporates (or embeds) an internal embedded clock signal ($CLK_E$) provided by first PLL 130 within the serial image data signal, thereby generating an embedded clock data signal ($D_CLK_E$). For example, assuming in one embodiment of the invention that a serial image data signal consists of 30 bits, the embedded clock data signal ($D_CLK_E$) may additionally include one dummy bit and one clock bit, or 30 serial data bits (Ds) and 2 embedded clock bits. However, the number of data bits contained in the embedded clock data signal ($D_CLK_E$) may be predetermined at any reasonable level.

First PLL 130 provides the internal embedded clock signal ($CLK_E$) to data serializer 120 and also provides a corresponding internal clock (CLK) to TMDS encoder 110. Transmission (Tx) driver 140 communicates the embedded clock data signal ($D_CLK_E$) to column driver 200 via a first data line 150.

Rx input buffer 240 receives the embedded clock data signal ($D_CLK_E$) from Tx driver 140. Rx input buffer 240 abstracts the serial data Ds and a recovered internal embedded clock signal ($CLK_{RX}$) from the embedded clock data signal ($D_CLK_E$).

Rx input buffer 240 communicates the serial data (Ds) to data deserializer 220 and the recovered internal embedded clock signal ($CLK_{RX}$) to second PLL 230. One possible circuit structure and related operating characteristics associated with the abstraction of the recovered internal embedded clock signal ($CLK_{RX}$) from the embedded clock data signal ($D_CLK_E$) will be described in some additional detail with reference to FIGS. 4 and 5.

Data deserializer 220 converts the serial data (Ds) received by Rx input buffer 240 into recovered parallel data Dp' in synchronization with a recovery clock ($CLK_N$) generated by second PLL 230. An exemplary technique of converting the serial data Ds into the recovered parallel data Dp' will be described in some additional detail with reference to FIG. 6.

Data deserializer 220 outputs the recovered parallel data Dp' to TMDS decoder 210. TMDS decoder 210 performs a TMDS decoding operation in relation to the recovered parallel data Dp'.

Thus, from the foregoing, it may be seen that according to one embodiment of the invention, data communication may be accomplished using a three-level signaling technique between a timing controller and a corresponding column driver using an embedded clock data signal. As a result, an intra-panel interface incorporating the embodiments may be used to reduce the number of channels (or lines) needed to communicate image data between the timing controller and related column drivers, thereby lessening the EMI effects and decreasing power consumption.

Figure 3:
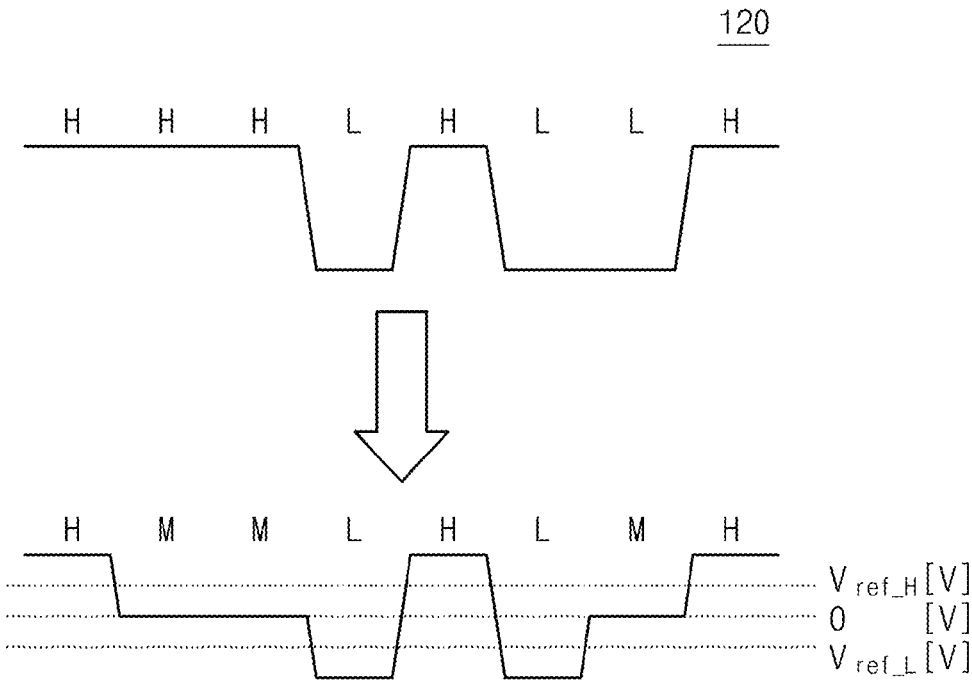
FIG. 3 is a timing diagram further illustrating the operation of the data serializer shown in FIG. 2.

FIG. 3 is a timing diagram further illustrating the operation of data serializer 120 of FIG. 2.

As noted above, the illustrated embodiment of the invention assumes a three-level signaling scheme. Referring to FIG. 3, a data signal is included in at least one of high, middle, and low states. The high state is associated with a voltage greater than a first reference voltage (Vref_H), the low state is associated with a voltage less than a second reference voltage (Vref_L), and the middle state is associated with an intermediate between the first and second reference voltages (Vref_H and Vref_L). The first reference voltage (Vref_H) may be defined between a power source voltage and ground, and the second reference voltage (Vref_L) may be defined between a negative power source voltage and ground.

A middle state is given to a "same value" as a previous data bit. For instance, if a previous data bit is "high" and a current data bit is "middle", the current and previous data bits are both '1'. If a previous data bit is "low" and a current data bit is "middle", the current and previous data bits are both '0'.

Therefore, the three-level signaling scheme used to communicate data between a timing controller and column drivers according to certain embodiments of the invention is advantageous in that data may be communicated at relatively high speed with reduced EMI effects and reduced power consumption.

Figure 4:
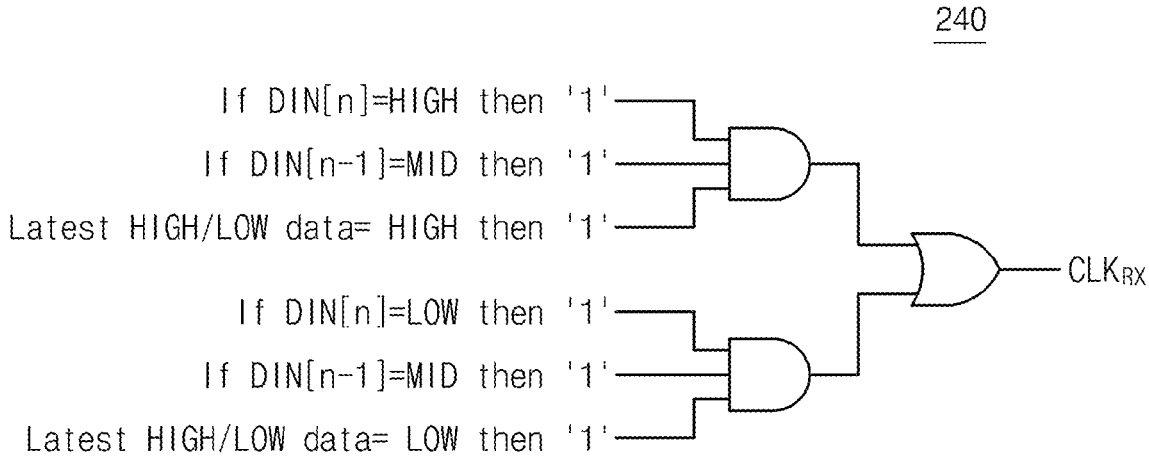
FIG. 4 is a gate-level diagram showing one exemplary structure of the reception input buffer shown in FIG. 2.
Figure 5:
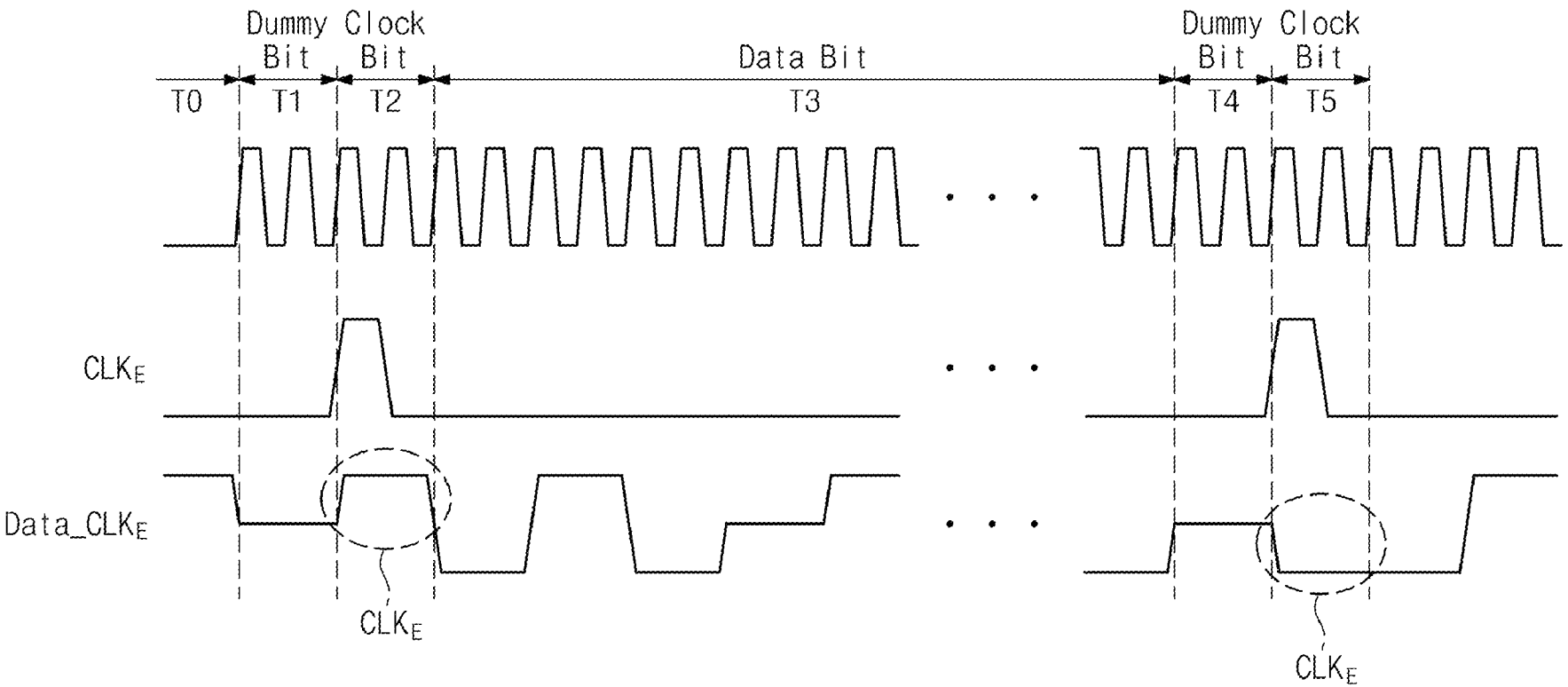
FIG. 5 is a timing diagram further illustrating the operation of the timing controller shown in FIG. 2.

FIG. 4 is a gate-level diagram illustrating one possible structure of Rx input buffer 240 shown in FIG. 2, and used to abstract the recovered internal embedded clock signal ($CLK_{RX}$) from the embedded clock data signal ($D_CLK_E$). FIG. 5 is a related timing diagram further illustrating the operation of data serializer 120.

Referring to FIG. 4, the abstraction of the received internal embedded clock signal ($CLK_{RX}$) from the embedded clock data signal ($D_CLK_E$) is carried out as follows. If a current data bit in the embedded clock data signal (i.e., DIN[n]) is high, a previous data bit in the embedded clock data signal (DIN[n−1]) is middle, and a latest high/low data bit (i.e., "a next previous data bit"—or a next data bit not having a middle state or DIN[n−i], where i is the number of previous data bits having a middle state occurring before the previous data bit) is high, then the current data bit in the embedded clock data signal (DIN[n]) is determined to be a clock bit. Otherwise, if a current data bit in the embedded clock data signal (DIN[n]) is low, a previous data bit in the embedded clock data signal (DIN[n−1]) is middle, and a latest high/low data bit (or next previous data bit (DIN[n−2])) is low, then the current data bit in the embedded clock data signal (DIN[n]) is determined to be a clock bit.

Referring to FIGS. 2 through 5, data serializer 120 adds dummy and clock bits to the embedded clock data signal ($D_CLK_E$). As illustrated in FIG. 5, during periods T1 and T4, Tx driver 140 communicates the dummy bit included in the embedded clock data signal ($D_CLK_E$) to column driver 200. During periods T2 and T5, Tx driver 140 communicates the clock bit included in the embedded clock data signal ($D_CLK_E$) to column driver 200. During a period T3, Tx driver 140 communicates the data bit of the embedded clock data signal ($D_CLK_E$) to column driver 200.

Then, to recover the clock bit apparent in period T2 from the embedded clock data signal ($D_CLK_E$), Rx input buffer 240 interrogates the state (high, low, or middle) of the data bits previously communicated within the embedded clock data signal ($D_CLK_E$) during previous periods T0 and T1.

Figure 6:
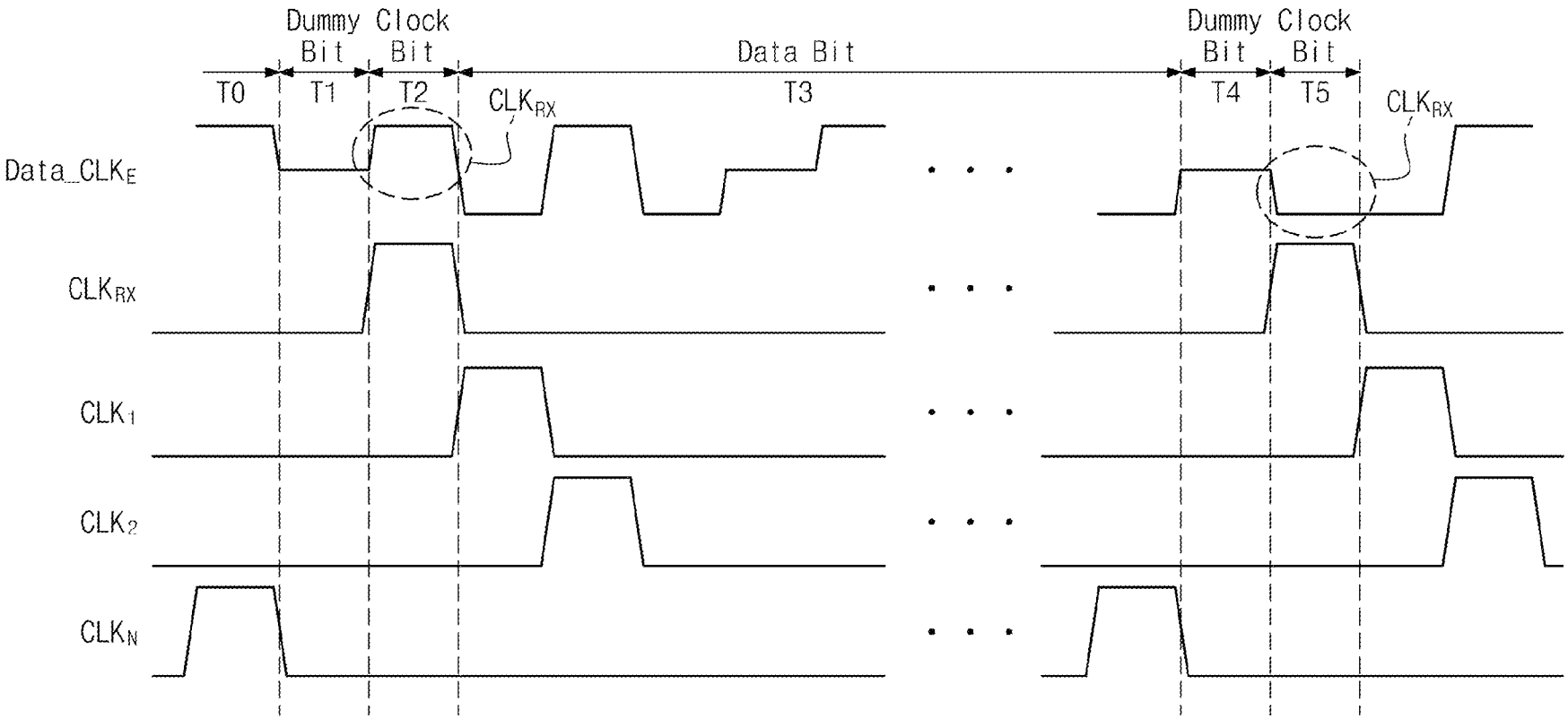
FIG. 6 is a timing diagram further illustrating the operation of the column driver shown in FIG. 2.

FIG. 6 is a timing diagram further illustrating the operation of column driver 200 shown in FIG. 2.

Referring to FIGS. 2 and 6, Rx input buffer 240 abstracts the serial data Ds and the recovered internal embedded clock ($CLK_{RX}$) from the embedded clock data signal ($D_CLK_E$). Rx input buffer 240 then applies the recovered internal embedded clock signal ($CLK_{RX}$) to second PLL 230. In response, second PLL 230 internally generates and uses a first clock $CLK_1$, a second clock $CLK_2$, . . . , and a Nth clock $CLK_N$. Namely, second PLL 230 generates the first through Nth clocks $CLK_1$~$CLK_N$.

During period T0, Rx input buffer 240 abstracts the clock bit from the embedded clock data signal ($D_CLK_E$). During periods T1 and T4, Rx input buffer 240 abstracts the dummy bit from the embedded clock data signal ($D_CLK_E$). During periods T2 and T5, Rx input buffer 240 abstracts the clock bit from the embedded clock data signal ($D_CLK_E$).

During period T3, data deserializer 220 converts the serial data Ds to the recovered parallel data Dp' using the first through nth clocks ($CLK_1$~$CLK_N$) provided by second PLL 230.

For instance, data deserializer 220 synchronizes the serial data Ds to the first clock $CLK_1$ provided by second PLL 230 in order to convert the serial data Ds to the recovered parallel data Dp'. Data deserializer 220 then synchronizes the serial data Ds to the second clock $CLK_2$ provided by second PLL 230 in order to further convert the serial data Ds to the recovered parallel data Dp'.

Data deserializer 220 sequentially synchronizes the serial data Ds to each one of the first through nth clocks ($CLK_1$~$CLK_N$) provided by second PLL 230 in order to convert the serial data DS to the recovered parallel data Dp'.

As aforementioned, data communicated is accomplished using a three-level signaling scheme between a timing controller and column drivers in relation to an input data signal having an embedded internal clock. Thus, an intra-panel interface incorporating an approach consistent with an embodiment of the invention may reduce the number of channels (or lines) required to communicate image data between the timing controller and the column drivers, thereby reducing EMI effects while decreasing power consumption.

Consequently, an intra-panel interface configured according to an embodiment of the invention is advantageous in that it is able to reduce the number of channels required to communicate image data between a constituent timing controller and the column drivers in the FPD device, thereby reducing EMI effects normally induced during data communication and reducing overall power consumption.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents.

What is claimed is:

1. A display device comprising:

a panel;

a timing controller generating an embedded clock data signal combining image data and a clock signal; and a column driver driving the panel in response to the embedded clock data signal, wherein data bits within the embedded clock data signal are communicated at one of three voltage levels in a three-level signaling scheme, including a high voltage level representing a first value of a data bit, a low voltage level representing a second value of a data bit, and a middle voltage level representing a value of a data bit that is the same as a previous data bit, wherein the timing controller determines whether a current data bit DIN[n] of the embedded clock data signal has a same value as a previous data bit DIM[n−1] of the embedded clock data signal, wherein, upon determining that the current data bit DIN[n] has the same value as the previous data bit DIN[n−1], the timing controller communicates the current data bit DIN [n] at the middle voltage level, and wherein, upon determining that the current data bit DIN[n] does not have the same value as the previous data bit DIN[n−1], the timing controller communicates the current data bit DIN[n] at the high voltage level to represent the first value, or at the low voltage level to represent the second value.

2. The display device of claim 1, wherein the voltage level of the current data bit (DIN[n]) within the embedded clock data signal is determined in relation to the voltage level of the previous data bit within the embedded clock data signal (DIN [n−1]) and a next previous data bit (DIN[n−i]) within the embedded clock data signal.

3. The display device of claim 1, wherein the three voltages levels in the three-level signaling scheme correspond to high, low, and middle states defined in relation to at least two reference voltages.

4. The display device of claim 3, wherein according to the three-level signaling scheme, if a current data bit (DIN[n]) within the embedded clock data signal has a middle state and a previous data bit (DIN[n−1]) within the embedded clock data signal has either a high state or a low state, then the current data bit (DIN[n]) within the embedded clock data signal has the same state as the previous data bit (DIN[n−1]) within the embedded clock data signal.

5. The display device of claim 3, wherein the high state corresponds to a voltage level for the embedded clock data signal that is greater than a first reference voltage, the low state corresponds to a voltage level for the embedded clock data signal that is less than a second reference voltage, and the middle state corresponds to a voltage level for the embedded clock data signal that is between the first and second reference voltages.

6. The display device as set forth in claim 5, wherein the first reference voltage is between a power source voltage and ground, and the second voltage is between a negative power source voltage and ground.

7. A display device comprising:

a timing controller configured to generate an embedded clock data signal wherein data bits within the embedded clock data signal are communicated at one of three voltage levels in a three-level signaling scheme, including a high voltage level representing a high state, a low voltage level representing a low state, and a middle voltage level representing a middle state, and the embedded clock data signal comprises a dummy bit communicated in a first time period and having the middle state, and a clock bit communicated in a time period next to the first time period and having either the high state or the low state; and a column driver receiving the embedded clock data signal and recovering the clock bit from the embedded clock data signal, wherein the clock bit has the high state if a previous data bit within the embedded clock data signal has the middle state and a next previous data bit has the high state, but the clock bit has the low state if the previous data bit has the middle state and a next previous data bit has the low state.

8. The display device of claim 7, wherein if the current data bit has the middle state and the previous data bit has the high state or the low state, then the current data bit has the same state as the previous data bit.

9. The display device of claim 7, wherein the high state corresponds to a voltage level for the embedded clock data signal that is greater than a first reference voltage, the low state corresponds to a voltage level for the embedded clock data signal that is less than a second reference voltage, and the middle state corresponds to a voltage level for the embedded clock data signal that is between the first and second reference voltages.

10. The display device of claim 9, wherein the first reference voltage is between a power source voltage and ground, and the second voltage is between a negative power source voltage and ground.

11. The display device of claim 7, wherein the embedded clock data signal is formed by a repeating sequence of image data bits, a dummy bit, and a clock bit.

12. The display device of claim 7, wherein the timing controller comprises:

a phase-locked loop (PLL) generating an internal embedded clock signal;

a data serializer converting an externally provided parallel input data signal into a serial data while embedding at least one bit derived from the internal embedded clock signal within the serial data to generate the embedded clock data signal; and a transmission driver communicating the embedded clock data signal to the column driver.

13. The display device of claim 12, wherein the timing controller further comprises a transition-minimized differential signaling (TMDS) encoder coding an internal clock signal corresponding to the internal embedded clock signal in a TMDS mode in relation to the input data signal prior to parallel to serial conversion.

14. The display device of claim 7, wherein the column driver comprises:

a reception input buffer abstracting serial data and a recovered internal embedded clock signal from the embedded clock data signal;

a PLL receiving the recovered internal embedded clock signal and generating a plurality of first through Nth clocks adapted to convert the serial data into recovered parallel data; and a data deserializer converting the serial data into the recovered parallel data in synchronization with the plurality of first through Nth clocks provided by the second PLL.

15. The display device of claim 14, wherein the column driver further comprises a TMDS decoder decoding the embedded clock data signal that is encoded in the TMDS mode.

* * * * *